United States Patent [19]

Mattila

[11] 4,191,179

[45] Mar. 4, 1980

[54] BODY MASSAGING APPARATUS

[76] Inventor: Alvin J. Mattila, 2 Beaver St., San Francisco, Calif. 94114

[21] Appl. No.: 4,404

[22] Filed: Jan. 18, 1979

[51] Int. Cl.[2] ..... A61H 11/00

[52] U.S. Cl. ..... 128/58

[58] Field of Search ..... 128/57, 58, 63, 24.3

[56] References Cited

U.S. PATENT DOCUMENTS

| | | | |
|---|---|---|---|
| 718,594 | 1/1903 | Bailey | 128/57 |
| 781,683 | 2/1905 | Shepherd | 128/58 |
| 806,482 | 12/1905 | Moore | 128/58 |
| 975,702 | 11/1910 | McCarthy | 128/58 |
| 1,827,874 | 10/1931 | Hemp | 128/58 |
| 1,849,629 | 3/1932 | Lewis | 128/58 |
| 2,549,933 | 4/1951 | Rohlffs | 128/58 |

FOREIGN PATENT DOCUMENTS

| | | | |
|---|---|---|---|
| 17750 | of 1895 | United Kingdom | 128/58 |

*Primary Examiner*—Lawrence W. Trapp

*Attorney, Agent, or Firm*—Thomas H. Olson

[57] ABSTRACT

Body massaging apparatus including two cables or like flexible members between which extend a plurality of parallel spaced apart massager units. Each massager unit has a rigid shaft on which is supported for rolling movement a rigid cylinder. On the exterior surface of the cylinder a flexible layer is secured. The flexible layer has integral resilient fingers protruding therefrom. The fingers are dimensioned so as to provide stimulation to parts of the body when the device is rolled thereover. A plastic tube circumscribes the cables, which plastic tube is employed to space the shafts apart and to afford a degree of resistance to rotation of the cylinders on the shafts, thereby enhancing the stimulative effect of the apparatus.

5 Claims, 5 Drawing Figures

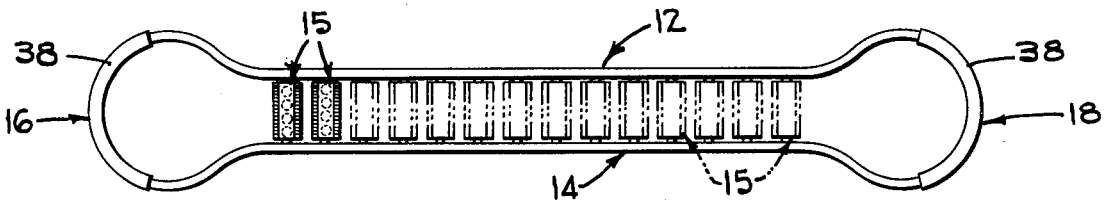
Fig-1
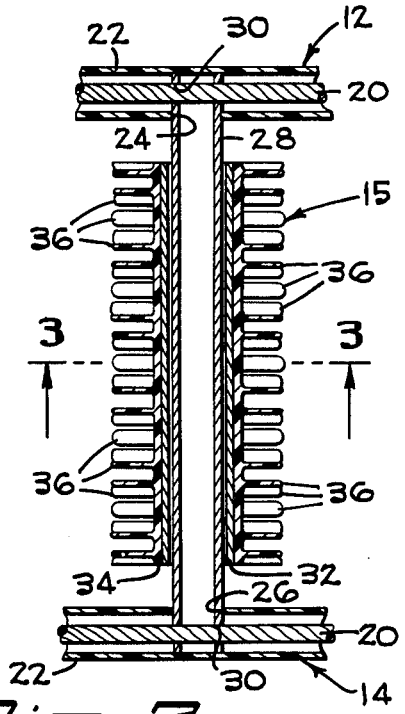
Fig-2
Fig-3
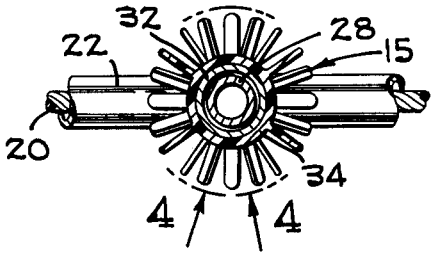
Fig-5
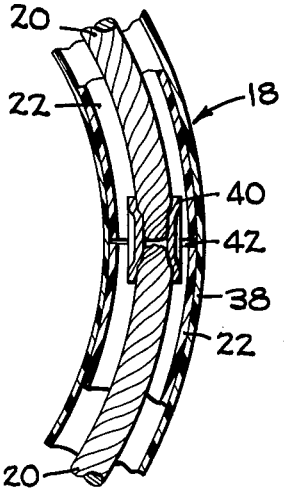
Fig-4
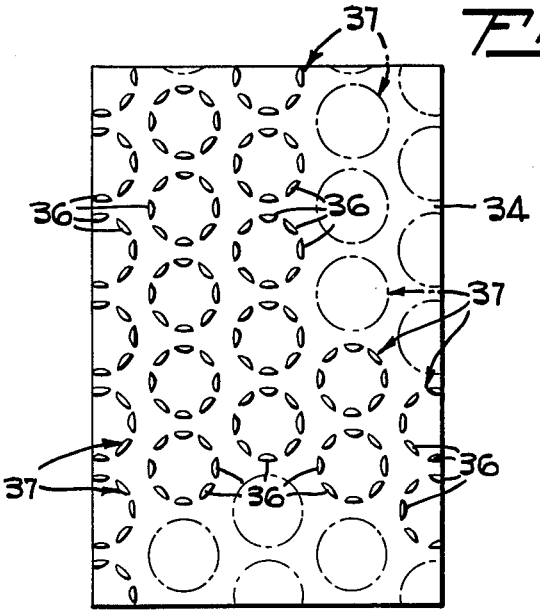

BODY MASSAGING APPARATUS

BACKGROUND OF THE INVENTION

1. Field of the Invention

This invention relates to a body massager and more particularly to a body massager that is flexible and has sufficient length that it can be employed in massaging virtually any part of the human body.

2. Description of the Prior Art

U.S. Pat. No. 718,594 to Bailey discloses a massager supported on a flexible band and having a plurality of rollers mounted for rotation on an axis which extends axially of the band. The rollers have rubber surfaces which define hollow bosses.

U.S. Pat. No. 1,516,344 to Knowles discloses a device wherein a plurality of rigid balls are supported for rotation on shafts which extend between rigid links.

U.S. Pat. No. 2,578,916 discloses a rigid device which has several rollers from which rubber teeth extend. Because the Belville device is rigid, it is extremely difficult for a person to use it on his or her own back.

Various configurations of flexible fingers as employed in massage devices are known. Examples of such fingers are shown in U.S. Pat. Nos. 2,080,208 to Illch; 3,037,500 to Daugherty and 4,052,982 to Ozeryansky.

SUMMARY OF THE INVENTION

According to the present invention, a length of cable is looped to form two elongate portions at opposite ends of which are shorter portions which form grips, or handles, for the device. The elongate portions support a plurality of shafts which are mounted thereto and extend therebetween in parallel spaced apart relation. Mounted for rotation on each of the shafts is a rigid cylinder, and on the exterior surface of the cylinder is secured a plurality of resilient fingers which extend radially thereof. The fingers are relatively long and narrow so that they stimulate the skin as they are rolled thereover. Because the device has substantial length it can be employed by a person to massage his or her back or other parts of the body to which direct access is difficult.

An object of the invention is to provide a massager that can be used on any part of the human body. This object is achieved because the device is supported on parallel flexible elongate members which support the above mentioned rollers, the elongate members being conformable to any body curvature. Consequently, the device will afford stimulation to substantial parts of the body which are inaccessible to other devices.

Another object of the invention is to provide a body massager that provides enhanced stimulation to the part of the body upon which it is moved. This object is achieved by providing resilient body contacting fingers which are dimensioned so as to provide excellent stimulation. More particularly, the fingers have a width dimension, a thickness dimension less than the width dimension so that each finger is flexible, and a length dimension greater than the width dimension. Moreover, the body contacting end of each finger is arcuately formed and has a thin edge so as to stimulate but not injure skin over which it is rolled.

Also contributing to the excellent simulation provided by the present invention is an arrangement which impedes but does not totally retard rotation of each of the cylinders on its axis. More particularly the invention includes a flexible, semiresilient sleeve which circumscribes each of the elongate members and presents a surface against which the ends of the cylinders can bear so as to retard or partially brake rotation of the cylinders whereby as the device is moved over the body the fingers slide to some degree over the skin surface. The sleeve also functions to retain the massager units in a parallel spaced apart relation.

Still another object is to provide a body massager which can be conveniently stored when not in use. Because of the flexibility of the members on which the rollers are supported the massager can be folded for placement in a drawer. Alternatively, because the massager is in the form of a closed loop it can be conveniently hung on a closet hook or the like.

The foregoing together with other objects, features and advantages will be more apparent after referring to the following specification and the accompanying drawings.

BRIEF DESCRIPTION OF THE DRAWINGS

FIG. 1 is a plan view of a body massager embodying the present invention.

FIG. 2 is a cross-sectional view taken through one of the rollers that constitute part of the invention.

FIG. 3 is a sectional view taken substantially along line 3—3 of FIG. 2.

FIG. 4 is a view of a fragment of the roller surface embodying the present invention taken substantially along line 4—4 of FIG. 3.

FIG. 5 is a fragmentary view at enlarged scale of a portion of one of the handles.

DESCRIPTION OF THE PREFERRED EMBODIMENT

Referring more particularly to the drawing, reference numeral 12 indicates a first flexible elongate tension member and reference numeral 14 indicates a second substantially identical flexible elongate tension member. A plurality of rotatable massager units 15 extends between the elongate tension members. As can be seen in FIG. 1, the elongate members 12 and 14 are part of a closed loop, there being at opposite ends of the elongate members handle portions generally indicated at 16 and 18.

Elongate portions 12 and 14, as well as handle portions 16 and 18, are of substantially identical construction. Referring to FIG. 2, the elongate members include a centrally disposed stranded steel cable 20 which according to one structure designed in accordance with the invention has an outer diameter of approximately 3/16–¼ inch. Circumscribing cable 20 is a hollow flexible semi-resilient plastic sleeve 22. As can be seen in FIG. 2, the inside diameter of plastic sleeve 22 exceeds the outside diameter of stranded cable 20. The portions of plastic sleeve 22 within elongate members 12 and 14 are formed with a series of circular openings, there being a series of openings 24 in the portion of the sleeve defining elongate member 12 and an oppositely positioned series of openings 26 in the portion defining elongate member 14. Extending through each confronting pair of openings is a rigid shaft 28 which can be of hollow construction as shown in FIGS. 2 and 3. At its opposite ends, shaft 28 is formed with diametrically extending bores 30 which are sized to receive cable 20 therethrough.

The outer surface of shaft 28 is cylindrical and supports for rotation relative to the shaft a hollow cylinder 32, the cylinder defining an opening that is slightly larger than the outside diameter of the shaft so as to permit the cylinder to rotate on the shaft. Fixed by means of adhesive or the like to the exterior surface of cylinder 32 is a body stimulating member which includes a flexible base sheet 34 having a plurality of integral fingers 36 which project in a radial direction therefrom. Flexible base sheet 34 and fingers 36 are formed of flexible resilient material such as rubber or synthetic plastic.

Fingers 36 have a length dimension in a direction radially of the axis of rotation of cylinder 32, a thickness dimension which is measured in a direction radially of the circular patterns 37 shown in FIG. 4 and a width dimension measured in a direction tangentially of such circular patterns. To provide good massaging action it is preferred that the length to width ratio of fingers 36 is at least about 2 to 1. As can be seen in FIGS. 2 and 3, the outer ends of fingers 34 are radiused so as to enhance the stimulative effect of the fingers on the skin. Because individual fingers are oriented obliquely of one another (see FIGS. 3 and 4), the amount of force required to deform individual fingers is different as the fingers roll over the user's skin.

As can be seen in FIG. 1, individual massager units 15 are spaced apart from one another along elongate members 12 and 14. The particular spacing between adjacent massager units 15 depends, in part, upon the diameter of each of the massager units and is established so that the massager units can roll freely without contacting one another. The spacing between adjacent massager units is sufficiently close, however, that elongate members 12 and 14 are held out of contact with the skin during use of the device.

As can be seen in FIG. 2, the length of cylinder 32 is slightly less than the length of shaft 28 between the confronting surfaces of sleeve 22. This permits the cylinder and fingers 36 carried thereby to move axially of the shafts so that as the device is rolled over a body part, the rollers are subject to a varying degree of frictional contact with the surface of sleeve 22 and consequently to a varying degree of resistance to rotation. This enhances the stimulative effect of a massager embodying the invention because the forces imposed on the body vary continuously during use.

In fabricating a massager according to the present invention, the overall length of plastic sleeve 22 is established and openings 24 and 26 are formed therein at appropriate intervals and at a diameter corresponding to the outer diameter of shaft 28. The shafts are bored to form bores 30 in opposite ends thereof. Next, stranded cable 20 is inserted through sleeve 22 and through the bores in opposite ends of shaft 28. At handle portions 16 and 18 larger diameter tubular portions or sleeves 38 are installed over sleeve 22, the tubular portions 38 increasing the diameter to facilitate manual engagement and imparting a slight degree of rigidity which also facilitates engagement thereof. At handle portion 18, tubular portion 38 also functions to cover the joint in cable 20, formed by a compression sleeve 40 or the like and the joint in sleeve 22 as seen at 42. The inner diameter of tubular portion 38 is such that it can be slid over connector 40 and joint 42 after the same are engaged. Consequently, the exterior surface of the apparatus is smooth to enhance the appearance and utility thereof.

Because the handle portions and the elongate portions are flexible, the device can be manipulated so that the axes of rotation of massager units 15 can be established either normal to the direction of movement over a body surface or slightly oblique of normal, depending on the particular form of massaging action desired. The overall length of the massager, i.e., the distance between handle portions 16 and 18, is sufficient that it can be used on the back or similar inaccessible portions of the body of the user. In one device designed according to the present invention the overall length of the device, i.e., the distance between the handle portions, is approximately four feet; such exemplary device can be used to massage the user's back without requiring that the arms be unduly distorted or moved to a strained position.

The degree of resilience or flexibility of fingers 36 is established so that vigorous massaging of the skin can be effected but that the device can conform to irregularities in the surface of the body. The radiused portion at the outer or distal end of the fingers assures vigorous stimulation without puncturing the user's skin.

Because of the presence of stranded cable 20 the device has sufficient strength that even vigorous movement over the body will not in any way jeopardize the integrity of the device. Consequently, the device will serve the user thereof for a substantial period of time without requiring repair or replacement.

Thus it will be seen that the present invention provides a body massager which is extremely versatile in its use, which can be employed to massage virtually any part of the body, which is relatively inexpensive and efficient to produce and manufacture and which has almost unlimited longevity.

Although one embodiment has been shown and described it will be obvious that other adaptations and modifications can be made without departing from the true spirit and scope of the invention.

What is claimed is:

1. Body massaging apparatus comprising first and second elongate flexible tension members, first and second handle means connected to opposite ends of said elongate members for affording a hand grip thereto and supporting said elongate members in substantial parallel spaced apart relation, a plurality of parallelly spaced apart massaging units extending between said elongate members and supported thereby, each said massager unit including a shaft having first and second ends secured to respective said elongate members and spanning the space therebetween, a substantially rigid cylindric member defining a central opening sized for rotative movement on said shaft and having an exterior surface concentric therewith, a flexible sheet adhesively secured to said cylindric surface, and a plurality of resilient fingers integral with and projecting radially from said flexible sheet, said fingers having width and thickness dimensions and a length dimension greater than said width and thickness dimensions so that in response to manipulation of the apparatus by grasping said handles said members can be rolled over parts of the body to cause said points to roll upon and stimulate the skin.

2. Apparatus according to claim 1 wherein said elongate members include a length of stranded metallic cable and a flexible sleeve circumscribing said cable, said flexible sleeve defining spaced apart openings for snugly receiving said shafts therein, said shafts being diametrically bored at respective ends thereof to afford passage of said stranded wire cable therethrough.

3. Apparatus according to claim 2 wherein said cylindric member has a length less than the portion of said shaft intermediate portions of said sleeve, said cylindric member being axially movable on said shaft to afford frictional engagement between an axial extremity of said cylindric member and a portion of said sleeve surrounding said opening.

4. Apparatus according to claim 1 wherein said handle means and said elongate members are integral with one another, said handles being formed by loops extending from opposite ends of respective said elongate members.

5. Apparatus according to claim 1 wherein said fingers have a width dimension, a thickness dimension and a length dimension, said thickness dimension being substantially less than said width dimension, said length dimension being substantially greater than said width dimension, said fingers being arranged in plural circular sets on a flexible sheet, said width dimension of the fingers being oriented tangentially so that fingers in each circular set contact the body at different angles in response to rolling movement thereover.

* * * * *